United States Patent [19]

Hunter

[11] 4,378,289

[45] Mar. 29, 1983

[54] METHOD AND APPARATUS FOR CENTRIFUGAL SEPARATION

[76] Inventor: A. Bruce Hunter, 18 Westpark Blvd., Dollard des Ormeaux, Quebec, Canada

[21] Appl. No.: 223,103

[22] Filed: Jan. 7, 1981

[51] Int. Cl.[3] ..... B04C 5/14; D21D 5/24

[52] U.S. Cl. ..... 209/211; 210/512.1

[58] Field of Search ..... 209/211, 144; 210/512.1; 55/92, 204, 237, 238, 235, 460, 459 R, 448–451

[56] References Cited

U.S. PATENT DOCUMENTS

| | | | |
|---|---|---|---|
| 2,102,525 | 12/1937 | Freeman | 209/211 |
| 2,346,005 | 4/1944 | Bryson | 209/211 X |
| 2,377,524 | 6/1945 | Samson | 209/211 |
| 2,757,581 | 8/1956 | Freeman et al. | 209/211 |
| 2,757,582 | 8/1956 | Freeman | 209/211 |
| 2,920,761 | 1/1960 | Freeman et al. | 209/211 |
| 2,927,693 | 3/1960 | Freeman | 209/211 |
| 2,967,618 | 1/1961 | Vane | 209/211 |
| 3,177,634 | 4/1965 | Latham et al. | 55/238 X |
| 3,337,050 | 8/1967 | Labecki | 209/211 |
| 3,488,924 | 1/1970 | Reeve | 55/92 X |
| 4,229,192 | 10/1980 | Calaceto | 55/238 |

FOREIGN PATENT DOCUMENTS

| | | | |
|---|---|---|---|
| 479486 | 12/1951 | Canada . | |
| 523370 | 4/1956 | Canada . | |
| 532770 | 11/1956 | Canada . | |
| 556239 | 4/1958 | Canada . | |
| 588343 | 12/1959 | Canada . | |
| 588344 | 12/1959 | Canada . | |
| 686793 | 5/1964 | Canada . | |
| 789373 | 7/1968 | Canada . | |
| 856570 | 11/1970 | Canada . | |
| 1062628 | 9/1979 | Canada . | |
| 1085317 | 9/1980 | Canada . | |
| 1314386 | 12/1962 | France | 209/211 |
| 837157 | 6/1960 | United Kingdom | 209/211 |

*Primary Examiner*—Ralph J. Hill

*Attorney, Agent, or Firm*—Kirby, Shapiro, Eades & Cohen

[57] ABSTRACT

A centrifugal separator of the type commonly used in the papermaking industry is modified to discharge both the accept and reject flows from the smaller end of a frusto-conical chamber. The reject flow takes place through a peripheral opening and the accept flow through an axial opening. The method is also applicable to the separation of other fluid mixtures.

21 Claims, 4 Drawing Figures

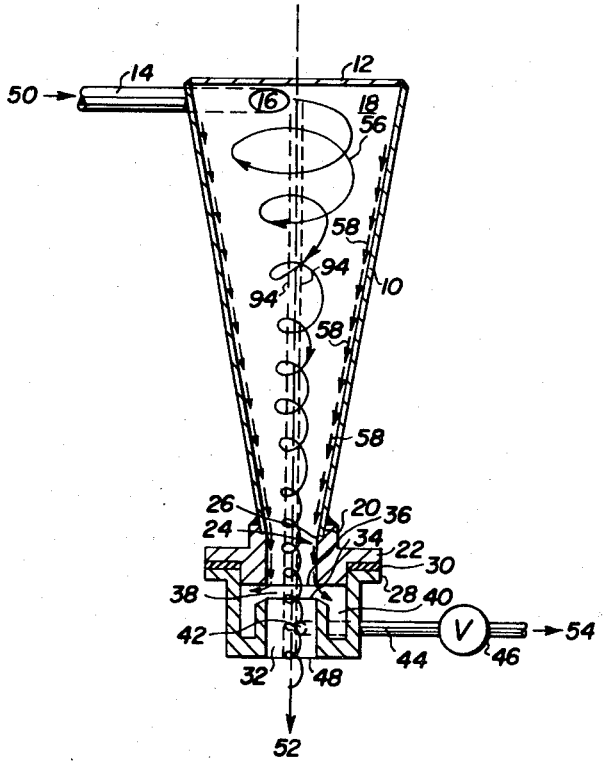

METHOD AND APPARATUS FOR CENTRIFUGAL SEPARATION

FIELD OF THE INVENTION

The present invention relates to the centrifugal separation of fluid mixture, e.g. the separation of solid particles in suspension in a fluid from the said fluid, or to the separation of a class, or classes, of particles from a mixture of particles in fluid suspension. The method and means of the present invention are particularly suited for, although not limited to, the separation of solid particles in liquid suspension into two or more classes, where the distinguishing characteristic for division into classes is density or specific gravity of the particles, or where the distinguishing characteristic is the specific surface, by which is meant the ratio of surface to volume, of the individual particles.

The present invention, although not restricted to the papermaking industry, has particular applications in the preparation of pulp stock for papermaking. Other applications, in the chemical processing, mineral dressing, waste water treatment, and other industries, will be readily apparent to those skilled in the art.

For example, the separation of entrained or suspended liquid droplets from a carrier stream of a gas or vapour can be accomplished by the apparatus and method of the invention, a process that has numerous applications in chemical processing, oil refining, and other industries.

By way of further example, the well-known dust collector cyclones, in which the air flow leaves through an opening in the base of the cone, are widely and successfully used to remove suspended solid particles from an air stream, where the particles are of relatively large size, such as sawdust and the like. However, where the particle size is very small, and particularly where the density is not great, such as the removal of fine fly-ash from boiler flue gases, for example, they have met with only limited success. The present apparatus and method will be useful for this purpose, in concentrating the particles into a smaller, more concentrated gas stream, which can then be further processed by filtration, electrostatic precipitation, or other processes. This will be of great value in processing only a small stream with sophisticated methods, rather than the full flow.

The term "fluid mixture" as used in the accompanying claims is thus intended to cover mixtures of liquids, gases and solids in which at least one fluid is present and in which the components are susceptible of separation by centrifugal force.

BACKGROUND OF THE INVENTION

For purposes of illustration the invention will be mainly exemplified with reference to the fluid feed stock commonly encountered in the papermaking industry.

The stock used in papermaking ordinarily consists of fibres, which are often wood fibres but may also be of cotton or other materials, in water suspension. It commonly happens that these wood fibres in water suspension are contaminated by the presence of undesirable particles, which may include sand, metal filings, and the like, but which also may include bark particles from the original log, incompletely pulped particles from knots in the wood, and the like.

In the paper industry, it is well-known to use what are called in that industry "centrifugal cleaners" or, more simply, "cleaners" to separate undesirable particles from the good pulp. These are devices of the type otherwise more generally known as "liquid cyclones," or sometimes as "hydrocyclones."

The centrifugal cleaners used in papermaking stock preparation ordinarily consist of a closed, hollow, slightly truncated, inverted cone, of metal, ceramic, plastic, or other rigid material, having a closed base of the cone at the upper end, provided with an inlet pipe or inlet orifice or orifices, which enter tangentially, at the top, near the cone base, and into which a dilute suspension of papermaking stock is pumped under pressure by an external pump connected by suitable piping; and additionally provided with an axial exit pipe or "accept pipe" from the center of the base of the cone, which accept pipe projects axially inward for a short distance into the interior of the hollow cone to form the so-called "vortex finder"; and additionally provided with an axial opening or orifice sometimes called the "reject tip" at the apex of the cone, which, as usually mounted, is at the lower end of the cone.

In the operation of centrifugal cleaners, the stock is pumped continuously into the device through the tangential inlet, under some considerable pressure, entering at relatively high velocity, and rotates rapidly within the hollow cone, from which two streams emerge, the larger fraction of the incoming stock leaving by the accept pipe through the cone base, and called the "accept flow" or "accepts", while the smaller fraction, called "reject flow" or "rejects", leaves by way of the reject tip in the apex of the cone. The rapid spinning or spiralling motion of the stock within the hollow cone causes the suspended particles to be subjected to large radial acceleration forces, or centrifugal force. Since the useful and desirable fibres for papermaking have densities or specific gravities very close to that of the suspending water, and since the contaminating particles are frequently of greater density, the heavy contaminating particles tend to be thrown outward toward the wall of the cone, where they travel in a spiral path downward toward the reject tip, in the so-called "dirt lamella", immediately adjacent to the wall of the cone. A large proportion of the heavy particles leave with the reject flow through the reject tip. The accept flow contains a substantially reduced concentration of the undesirable particles of higher density, compared with the incoming flow or "feed flow".

Centrifugal cleaners, as presently used in the industry, are characterized by the fact that a relatively high reject flow must be maintained for their proper operation. While it is typical that the undesirable high density particles in the incoming feed flow comprise less than one percent of the total weight of particles in the feed flow, good operation, and good removal of the said high density particles from the accept flow can nevertheless only be obtained if the proportion of solid particles in the reject flow is fifteen percent to twenty percent, or even more, of the weight of particles in the feed flow. Therefore, an undesirably high percentage of good fibre is rejected with the undesirable particles in the reject flow.

Considerable research has been done on centrifugal cleaners over many years by various investigators, and there is an extensive technical literature on the subject. The said research has established that despite the mechanical simplicity of the device, there is a quite complex flow pattern of the stock, or fluid, within a centrifugal cleaner when it is in operation. Specifically, it may be noted here that there exists in all operating centrifugal cleaners, as a component of the abovementioned complex flow pattern, what has been called the "leakage flow." There is a small continuous flow radially inward across the underside of the closed top of the device, which is the base of the cone, down the outside of the vortex finder to the open end of the said vortex finder, and thence out the accept pipe. This fraction of the flow through the device, the leakage flow, comprises some fraction of the incoming feed flow which passes through the device without being subjected to any substantial radial acceleration, or centrifugal force, and which thus does not have the undesirable contaminant particles removed from it. Furthermore, it is understood by those skilled in the art, that no changes in the geometric configuration of the device, such as change in the dimensions, diameter, cone angle, or shape, size, or surface configuration of the interior surface of the cone base or of the vortex finder, can entirely eliminate the leakage flow. It is recognized that the leakage flow is characteristic of centrifugal cleaners as presently used, because it is induced in accordance with the well-known laws of fluid mechanics, by viscous drag and fluid friction typical of the flow of all real fluids past a solid boundary, which is sometimes spoken of as the "boundary layer effect".

Thus it may be stated that, in all centrifugal cleaners heretofore used in the papermaking industry, which is to say those devices in which the accept flow leaves the device axially through the cone base, with or without the use of a vortex finder, the separation of undesirable particles can never be complete, because of the existence of the leakage flow.

SUMMARY OF THE INVENTION

It is one of the objects of this invention to disclose a method of centrifugal separation characterized by the fact that there is no leakage flow, and further to disclose suitable apparatus whereby the method may be put into practice.

To this end, the invention consists of a method of centrifugal separation of heavier and lighter fractions from a fluid mixture comprising (a) discharging said fluid mixture under pressure with at least a tangential component of velocity into an inlet end of an elongated chamber of circulated internal cross-section that diminishes in diameter from the inlet end to an outlet end whereby to cause all said fluid mixture to flow around and along said chamber towards the outlet end and at least partially to separate into a heavier, radially outwardly located fraction and a lighter, radially inwardly located fraction, and (b) extracting said heavier fraction at a periphery of the outlet end substantially without interference with smooth flow of said lighter fraction in the longitudinal direction.

The invention also provides apparatus for centrifugal separation comprising (a) an elongated chamber of circular internal cross-section diminishing in diameter from an inlet end to an outlet end, (b) the inlet end being closed except for means for discharging pressurized fluid mixture into said inlet end with at least a tangential component of velocity whereby to cause such fluid mixture to flow around and along said chamber towards the outlet end with at least partial separation of the fluid mixture into a heavier, radially outwardly located fraction and a lighter, radially inwardly located fraction, and (c) the outlet end having an axially located, first opening to receive predominantly the lighter fraction and a peripherally located, second opening to receive predominantly the heavier fraction, said second opening being formed as an interruption in an outer wall that is otherwise smoothly continuous in the longitudinal direction of flow.

In centrifugal cleaners as presently known, the ratio of the volume of reject flow to the incoming feed flow is dependent upon two major variables, the pressure differential between the inlet flow and the accept flow, and the diameter of the orifice in the apex of the cone. Since the diameter of the said orifice cannot readily be changed with the device in operation, and since variations of the differential pressure can usually only be made by throttling of fluid flows, with a consequent loss of mechanical energy which cannot be recovered or used, it becomes difficult and time-consuming to optimize performance of a given device, and very difficult or impossible to make adjustments during the operation of the device, to compensate, for example, for a changed concentration of undesirable particles in the incoming feed flow.

It is a further feature of the preferred embodiments of the present invention to provide a method whereby the ratio of reject flow to accept flow in a device for centrifugal separation of a fluid suspension, may be readily and quickly made by use of known, simple means, such as a valve.

As has been stated herein, it has been found necessary, in centrifugal cleaners as hitherto known, to cause the device to operate with "reject rates", by which is meant the ratio of reject flow rate to incoming feed flow rate, usually expressed as a percent, which are many times greater than the percentage of undesirable particles in the incoming feed flow. It will be apparent then, that the reject flow contains considerable quantities of good fibre. It will also be apparent that it is not economically possible to discard this rejected good fibre. It has thus been common to dilute the rejected flow, which, typically, has a somewhat higher concentration of total suspended particles than the incoming feed flow, and pass it through a second centrifugal cleaner, or group of such cleaners, known as a "secondary cleaner", or, in a group, as secondary cleaners. Now the feed flow to the secondary cleaner contains a relatively much higher concentration of undesirable particles than does the feed flow to the first cleaner as herein described, or "primary cleaner." As a consequence, the accept flow from the secondary cleaner contains a higher concentration of undesirable particles than does the accept flow from the primary cleaner. This is of course in part due to the existence of the leakage flow, whereby a portion of the feed to the secondary bypasses directly to the accept flow without having any substantial centrifugal force exerted on it.

It is usual practice to return the secondary accept flow to be added to the primary feed flow. Similarly, the rejects from the secondary are passed through a third cleaner or "tertiary cleaner," with the accepts from the tertiary being returned to be mixed with the secondary feed, and so on. This is often called a "cascade system".

Systems with three or four stages are common within the paper industry, and five or even more stages are not uncommon. It is usual to return the accepts from one stage (after the first stage) to the feed stock to the preceeding stage.

It is a further feature of the preferred embodiments of this invention that it enables the operation of cleaner systems with a lesser number of stages than would otherwise be possible. As it will readily be appreciated that each necessary stage involves the use of additional pumps and additional power to drive them, and the additional addition of dilution water to the system, as well as more floor space and larger numbers of cleaners, substantial savings can be made if the number of stages necessary to do an adequate job of removal of undesirable particles can be reduced.

In centrifugal cleaners as presently known, it is necessary to operate the devices with a relatively high differential pressure between the feed inlet and the accept outlet, with a pressure drop of 30 p.s.i. to 40 p.s.i. (for primary stage cleaners) being common. At the inlet to the cone, the pressure energy of the fluid in the feed flow is largely transformed into kinetic energy of the spiralling fluid. By the time the accept flow reaches the accept outlet, this kinetic energy has largely been dissipated by turbulence, shear forces, and fluid friction.

It is a further feature of one of the embodiments of the present invention to provide a method and appropriate means whereby at least some of the kinetic energy of the spiralling fluid can be recovered as pressure energy, by adding suitable means to the path followed by the accept flow (which in the present apparatus leaves through the apex of the cone), to convert the velocity energy, or kinetic energy, back to pressure energy.

In the cases where it is desired to convey the already cleaned stock, or accept flow, to some further part of the papermaking process, such as a paper machine headbox, while still under substantial pressure required in the said further part of the process, it is apparent that less total pump pressure will be required, needing less total power supplied to the pumps in the system. This provides a substantial energy saving on a continuing basis, which is an important advantage.

BRIEF DESCRIPTION OF DRAWINGS

The method and apparatus of embodiments of the present invention may be more readily appreciated by reference to the drawings in which.

DESCRIPTION OF PREFERRED EMBODIMENTS

In the disclosure which follows, while it is not the intention to restrict the field of the invention to the processing of papermaking stock, nor indeed to restrict the said field to the separation of a class of particles from a mixture of particles in liquid suspension, for clarity, in explaining the operation of the embodiments of the invention, the processing of papermaking stock will be taken as a specific example. Furthermore, the usual terminology of papermaking will be employed. This will facilitate understanding of the method of the invention, and of its advantages over methods hitherto commonly employed in the paper industry, as an extensive technical literature exists which describes the construction, operation, and results of devices for similar purposes, as used in the papermaking industry.

Figure 1:
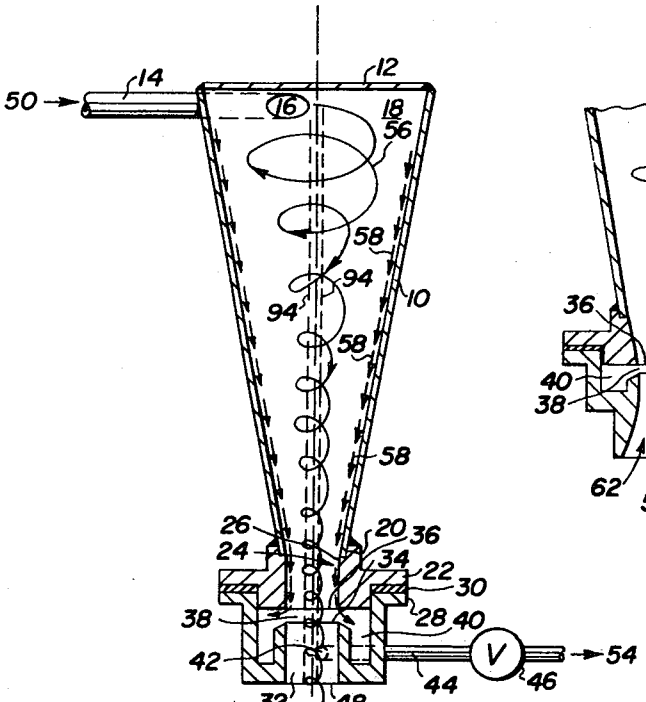
FIG. 1 is a vertical section of one embodiment of the invention, with the section taken through the axial centerline of the device.

In FIG. 1, a rigid, imperforate, hollow, conical shell 10 (it is actually frusto-conical, but will for simplicity be referred to as "conical") is supported by any suitable conventional support means not shown. The said conical shell 10, as well as the other component parts of the embodiment of FIG. 1, as well as of the other embodiments described herein, may be made of metal or other suitable materials, which materials might include ceramic, plastic, glass, or other material. In the embodiments shown in the Figures, for use with papermaking stock, the material of construction can be considered to be stainless steel, with various components joined by welding, as indicated.

In FIG. 1, the conical shell 10 is shown inverted, that is, with its axis vertical, and the small end of the cone down. However, it should be understood that the axis of the cone may be horizontal, or inclined at any angle to the vertical, or even inverted with the small end of the cone up.

The larger end of conical shell 10, which constitutes the inlet end of the apparatus is completely and imperforately closed by a cover plate 12. In the Figure, it is shown to be joined by welding, although other means, including but not limited to a bolted flanged connection, a screwed connection, or a clamped connection are possible.

An inlet conduit or pipe 14, communicates with the interior conical space or chamber 18 through an opening 16. The conduit 14 and opening 16 are disposed in a tangential manner, and the opening 16 is located close to the cover plate 12, which is to say at the large end of the cone.

The inlet conduit 14 may also be introduced through the cover plate 12, in an oblique but generally tangential manner. The liquid fed through the conduit 14 would then have some axial component of velocity as well as principally a tangential component. Other inlet means may be employed including angled slots and angled vanes. However, the preferred embodiment is as shown in FIG. 1.

The said cover plate 12, here shown flat, may also be domed, which is to say concave as viewed from the interior space 18, or alternatively, may be depressed, which is to say convex as viewed from the interior space 18.

The conical shell 10 is shown herein as a true cone, truncated at the apex, that is, the sides of the cone form a surface of revolution generated by a straight line rotated about the axial centerline. However, it should be appreciated that the invention can be worked with a generally cone shaped but barrel-like shell, or alternatively, with a somewhat trumpet-shaped shell. The essential requirements, for proper working of the invention, are that the shell 10 is of circular cross-section in the sense that it defines a surface of revolution about the axial centerline; that the shell 10 and the cover 12 are interiorly smooth and regular; that the shell 10 is elongated and dimnishes in diameter from the large inlet end to the small (outlet) end; and that, except for one or a plurality of tangentially disposed inlet openings 16, the cover plate 12 and the conical shell 10 throughout at least the major portion of its length from the large end toward the small end, are imperforate.

The conduit 14 is shown in the Figure as a round pipe, but may have another form, being elliptical, ovoid, rectangular, or square in cross-section, in which case the tangential opening 16 will be of suitable shape to receive the conduit.

As stated, the said conical shell 10 is truncated near its apex, at the point depicted by 20 in the Figure, where it is rigidly attached to a transition piece 22, by welding or other means. The transition piece 22 has an axial cylindrical central aperture 24 which communicates with the open end 20 of the shell 10. Transition piece 22 may advantageously be slightly rounded or tapered at the point 26, being the upper end of aperture 24, to provide a smooth transition between the sloping sides of the shell 10 and the cylindrical sides of the aperture 24.

A reject piece 28 is removably connected by flanges and flange bolts, which flange bolts, being conventional, are omitted in FIG. 1, to the transition piece 22, being maintained in axial alignment with it by spigotting, the joint being sealed by a conventional gasket 30, which also serves as a shim. The said reject piece 28 contains an axial, cylindrical central aperture 32, having the same diameter as, and in axial alignment with, the central aperture 24 of the transition piece 22.

A lip 34, forming part of the reject piece 28, at the upper end of the aperture 32 of such reject piece 28, together with an edge 36 at the lower end of the aperture 24 of the transition piece 22, together define a circumferential reject opening 38, which encircles the cylindrical flow passageway which may be considered to be defined by the two collinear apertures 24 and 32.

The width of the reject opening 38, in the axial direction, is short, and this width can be increased or decreased by employing a thicker or thinner gasket 30, which also serves as a shim, on assembly of the device.

The reject opening 38 communicates with an annular reject plenum 40, which, in turn, communicates through a reject outlet port 42 with a reject outlet conduit 44, to which may be added a throttling control valve 46 of conventional design. The reject outlet port 42 and the reject outlet conduit 44 are tangentially disposed, with respect to the reject plenum 40.

The lower edge of the aperture 32 of the reject piece 28 defines an accept opening 48. As shown in the Figure, the opening 48 may be arranged to discharge into an open tank, trough or flume. However, it will usually be found advantageous to add a flow conduit, such as a pipe or a flexible hose or a fabricated metal manifold or the like, to the reject piece 28 below and surrounding the opening 48. As this can be readily accomplished by adding to the reject piece 28, on the lower part thereof, suitable means for a flanged or threaded pipe connection, or a shank suitable to accommodate the clamped connection of a flexible hose, and since such means may be entirely conventional, they are omitted in FIG. 1 for clarity and simplicity.

In operation, a feed flow of papermaking stock, consisting of wood fibres or other fibres, which may be contaminated by being admixed with other undesirable solid particles, in dilute suspension in water, is pumped into the device under pressure from an external pump, not shown, as depicted by an arrow 50, through the inlet conduit 14 and the opening 16, and is divided by the apparatus into two efferent flows, the major (predominantly lighter) fraction leaving axially through the opening 48 as an accept flow, depicted by an arrow 52, and the minor (predominantly heavier) fraction or reject flow leaving peripherally through the opening 38 and then tangentially through the conduit 44 as depicted by an arrow 54.

It will be appreciated that the peripheral opening 38 is formed as in interruption in an outer wall of the apparatus that is otherwise smoothly continuous in the longitudinal direction of flow.

Liquid cyclones or other devices for centrifugal separation, also variously called hydrocyclones or hydroclones, have long been known, and devices of this type have been widely used in pulp and paper manufacture, where they are usually called "centrifugal cleaners." An extensive body of technical literature exists, including considerable patent art. An excellent general reference is the book, "The Hydrocyclone" by D. Bradley, published by Pergammon Press Ltd., Oxford, England, which is Volume 4 of the International Series of Monographs in Chemical Engineering.

Centrifugal cleaners, as used in the paper industry, like liquid cyclones generally, usually consist of a cone shaped device, with feed flow introduced tangentially at the large end of the cone, and usually with two axial outlets, one through a conduit passing axially through the base of the cone, and projecting inwardly for a short distance to form the so-called vortex finder, and the other through the apex of the cone. The lighter density fraction called "accepts" in the paper industry, leaves through the vortex finder and the opening through the base of the cone, and the heavier fraction called "rejects" in the paper industry through the cone apex, which is sometimes equipped with a variety of auxiliary devices, which have been the subject matter of numerous patents.

In the preparation of stock for papermaking, it frequently happens that the papermaking fibres are intermixed with other solid particles which are undesirable. These may include particles which have higher density than the useful fibres, including foreign material such as sand, metal filings and the like, but also including bark specks, incompletely pulped particles originating in knots in the wood, and the like. It has become usual to separate these with centrifugal cleaners. The good fibre, which has a density very close to that of the carrying water, leaves with the major flow through the base of the cone, and the higher density contaminants leave through the cone apex. However, the separation is not very sharp, and it has been usual papermaking practice to operate, as is said, at high reject rates. That is, to ensure that the amount of undesirable heavy particles leaving the centrifugal cleaner with the accept flow or accepts, by which is meant the major flow through the base of the cone, is at an acceptable low level, the devices are so designed, arranged, and operated that a considerable quantity of good fibre leaves with the undesirable particles in the reject flow, by which is meant the flow through the apex of the cone.

Typically, the proportion by weight of the undesirable heavy particles in the feed flow is less than one percent of the total weight of solid particles. However, reject rates, by which is meant the proportion by weight of the total of solid particles in the reject flow to the total weight of solid particles in the feed flow, of 15% or 20% are common, and even higher rates are known. Obviously, this good fibre in the rejects cannot simply be discarded along with the undesirable particles, and so a well-established technique has evolved of arranging several stages of cleaners in "cascade", as it is called. By this is meant that the reject flow from the first stage cleaner is diluted with water or dilute stock from some other source, then pumped into a second stage cleaner, with the accepts from the second stage device being returned to be mixed with the primary stage feed, and the rejects from the second stage being diluted once again, and passed to the feed of a third stage. The third stage accepts are returned to be mixed with second stage feed, and so on. Four stages are common in the industry, and five or even six are not unknown. It is clear that a device, or a method, permitting a more precise discrimination, and thereby permitting operation with fewer stages, is highly desirable.

Many investigators have studied the hydrodynamic behaviour of fluids and suspended particles in cyclones, and a good theoretical understanding has been reached. In liquid cyclones, the early fundamental work of D. F. Kelsall, which has been well summarized by Bradley in the book cited, is notable.

The fundamental research of Kelsall and others, has revealed that the flow patterns within a centrifugal cleaner are quite complex. Notably in centrifugal cleaners as usually employed, there always exits what has been variously called a "short circuit flow" or sometimes a "leakage flow" which is a small flow radially inward across the inner surface of the base of the cone, axially along the outside of the vortex finder, then into the vortex finder with the accepts. This means that some fraction of the incoming feed flow will leave the device with the accept flow, without the solid particles in suspension in that fraction having been subjected to adequate centrifugal action for a long enough time to permit effective discrimination between particles of different densities. This means that "perfect" discrimination by density is never possible in a centrifugal cleaner of the usual design, and aids in understanding the necessity for, and the common use of, the high reject rates usual in the paper industry. Since the short circuit flow is generated by boundary layer behaviour and fluid friction, in accordance with the laws of hydrodynamics as presently understood, it is clear that the short circuit flow can never be eliminated in a device where the accept flow passes out through the base of the cone in the usual manner of centrifugal cleaners, and liquid cyclones generally.

The present invention discloses a method, and appropriate means, whereby suspended particles, for example in paper stock, may be effectively separated on a basis of density, without any possibility of a short circuit flow. In the embodiments of the present invention, the whole body of incoming fluid, or feed flow, is caused to pass from one end to the other of a conical separator, so that every suspended particle is subjected to dynamic forces from one end to the other of the device, hence causing a more accurate separation.

Kelsall and others have established that the tangential velocities within a liquid cyclone approximate relatively closely to those in a free vortex. In a free vortex, such as everyone has seen when pulling the plug in the bathtub, the tangential velocity in the outer region of the vortex obeys the relationship VR equals a constant. In liquid cyclones, the relationship is $VR^n$ equals a constant, where n is dependent on the design, and normally is between 0.5 and 1.0. This means that the velocity is greater, nearer the center of the vortex. Thus the action of a liquid cyclone is basically different from a centrifuge, which latter rotates at a constant angular velocity. Now it will be apparent that, in a device according to the present invention, as well as in liquid cyclones, and specifically in centrifugal cleaners as they are presently commonly used in the paper industry, the dynamic force which causes discrimination between particles of different densities is radial acceleration, or what is commonly called "centrifugal force", which can be expressed as $V^2/R$, and since V increases as R is reduced in a free vortex, the centrifugal force will be very much greater at short radii than at longer radii, and indeed, may well be orders of magnitude higher near the center of the vortex than near the wall.

In centrifugal cleaners as usually employed, a large portion of the flow passes quite directly to the accept outlet, spending very little time in the short radius part of the vortex. In the embodiments of the present invention, the total flow is caused to pass from the large end to the small end of the cone, so that all portions of the flow have a substantial residence time in the device, and, furthermore, as the flow passes from the larger end to the smaller end, the radii of rotation become shorter and shorter, the tangential velocities in the vortex increase, and the centrifugal force on the individual particles increases as the flow passes toward the smaller end.

By reference to FIG. 1 it will be seen that the feed flow 50 enters the device through conduit 14 and opening 16 under pressure, whereupon some of its pressure energy at inlet is converted to velocity energy, and it passes downward along a spiral vertical path depicted approximately and diagrammatically by spiral line 56. As it passes toward the smaller end of the cone, the tangential velocities in the vortex increase, due to the shorter radius of rotation with remaining pressure energy being progressively converted to velocity energy, and the centrifugal force increases very greatly, due to the combination of the increasing velocities and the reducing radius.

The undesirable heavy particles are flung outwardly to the inner surface of the conical shell 10, where they pass downward in a thin circumferential layer, in what has been called the "dirt lamella", as depicted diagrammatically by arrows 58. The dirt lamella will include at least a portion of the "boundary layer", as the term is understood in hydrodynamics, and, in accordance with the fundamental laws of hydrodynamics, will have a lower velocity than the contiguous fluid, and will tend to follow a solid boundary toward regions of shorter radius.

The undesirable particles in the dirt lamella will follow the inner wall of cone 10 downward, along the wall of cavity 24 until they reach the reject opening 38, into which they are propelled tangentially by reason of their inertia, passing to the annular reject plenum 40, while still retaining, it will be understood, some tangential velocity. They then pass outward through the tangential reject outlet port 42 to the reject conduit 44 and emerge as the reject flow 54.

The remaining flow, that is to say that which does not leave as the reject flow, leaves the device through the opening 48 as the accept flow 52.

The total flow of rejects, as a proportion of the feed stock, will depend on a number of variables. The pressure of the incoming feed stock 50 will have an effect, as well as any back pressure on the accepts due to the installation of an accept conduit which, as has been stated, may be provided below the opening 48, as the differential pressure between these two points will determine the amount of pressure energy available for conversion to velocity energy at the inlet to the device and down through the cone, which will, in turn, affect the sharpness of separation, as it will determine the maximum available centrifugal force. It will also influence the velocity and momentum of particles carried in the dirt lamella as they enter the reject opening 38.

With pressure and other operating variables constant, the proportion of rejects can be adjusted to a slight extent by the dimension, in the axial direction, of the reject opening 38, which can be adjusted on assembly.

However, the reject flow rate, and the reject rate as a proportion of feed, can be readily adjusted while the device is in operation, by a simple adjustment of the valve 46. Thus this embodiment discloses a simple method and convenient means for both more discriminatory separation of undesirable particles from good fibre than has been possible with the devices hitherto usual in the paper industry, and for accurate control of the reject rate within broad limits.

It will be appreciated that, in FIG. 1, certain dimensions have been exaggerated for clarity, and that the geometric proportions of various dimensions as shown in the Figure, do not necessarily reflect optimum design of devices for use in the paper industry.

There are numerous applications within the papermaking art where the present invention will be useful, and these vary with the absolute size of undesirable particles, with the density of the said particles, and with the consistency of the stock, by which is meant the proportion of total solids carried in a unit weight of water. Many applications will require many small diameter units operated in parallel, while others may be adaptable to treatment with one larger unit. In general, the smaller the particle size of the undesirable particle, the more centrifugal force will be needed to effect efficient separation; thus a smaller diameter device, and/or a higher inlet pressure will be needed.

As an indication of size and geometric proportion, it may be stated that the diameter at the large end of the cone may range from about 3 inches to about 36 inches in the majority of installations. The axial length of the cone part will, in the majority of applications, be between about 3 and about 10 times the diameter at the large end of the cone. The inside diameter of inlet conduit 14 will usually be less than $\frac{1}{3}$ of the diameter at the large end of the cone, but will usually be more than 1/10 of the said diameter. The diameters of apertures 24 and 32, in the transition piece 22 and the reject piece 28, respectively, will usually be between 0.7 and 2.5 times the diameter of the inlet conduit 14. The axial dimension of the reject opening 38 will depend in part on the total quantity of rejectible particles present in the incoming feed stock, and in part on the maximum dimension of the largest anticipated rejectible undesirable particle. In general, the axial dimension of the reject opening 38 will not usually be less than 3 times the maximum dimension of the largest rejectible particle.

Figure 2:
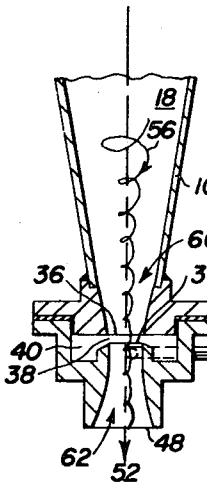
FIG. 2 is a partial vertical section, on the centerline, of a portion of another embodiment.

In FIG. 2 is shown another embodiment of the invention. Like numerals of reference denote like parts in the various figures. FIG. 2 shows only a portion of the device of the embodiment, and the upper portion of the device is similar to the embodiment of FIG. 1. Certain details, and numerals of reference have been omitted from FIG. 2, and are to be understood as being similar to those in FIG. 1. In FIG. 2, the axial central orifice 60 in the transition piece 22, and the axial central orifice 62 in the reject piece 28, together define a passageway with curved walls, rather than a cylindrical passageway as in the embodiment of FIG. 1. The reject opening 38 collectively defined by the lip 34 of the reject piece 28 and the lower edge 36 of the transition piece 22 is located at, or axially near (either above or below), the narrowest diameter of the said passageway with curved walls. The curved walls of this passageway, being a radially inwardly convex surface of revolution of compound curvature, may usefully be made to conform to the three dimensional geometric shape referred to mathematically as a hyperboloid of revolution. Such a shape might be described in everyday language as "a double-ended trumpet-shaped cavity". Other shapes for the collective cavity of orifices 60 and 62, whether describable as conforming to one or another known mathematical curve, or empirically arrived at, may also be used. For the smooth working of the apparatus, it will be sufficient that the curved walls of aperture 62 form a continuation of the same smooth curve as the curved walls of aperture 60, and that the reject opening 38 is axially located at or near the point of minimum diameter and, as in FIG. 1, represents an interruption in an otherwise smooth continuous outer wall.

A comparison of the annular reject plenum 40 of FIG. 2 with the same component of FIG. 1 will show that the size, shape, and geometric proportion of the reject plenum may be varied within rather wide limits, with little or no effect on the operation or efficiency of the apparatus.

Figure 3:
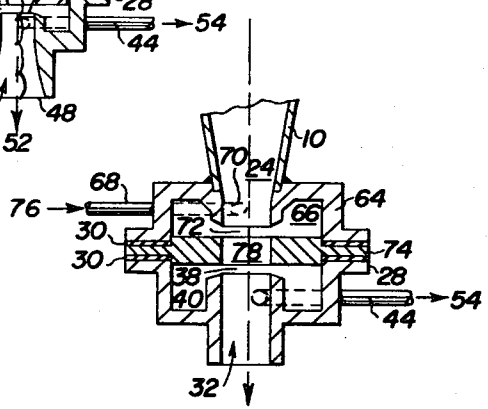
FIG. 3 is a partial vertical section, on the centerline, of yet another embodiment.

FIG. 3 depicts a partial section of yet another embodiment of the invention. In the application of centrifugal cleaners in the paper industry, it is well known in certain applications to add dilution water, or as it is often called "elutriation" water, to the device at or near the apex of the cone, or in means attached to or located below the reject opening in the tip of the cone. Such means have been called "reject regulators", "stock savers" and various trade names by different manufacturers. The purpose, generally, is to wash good fibre away from the undesirable heavy particles, either before such particles leave the reject orifice, or shortly thereafter, so that the good fibre may be recovered, either inside the cone of the cleaner, or in the appended means, after passing through the tip, and recovered in such appended means. The application of elutriation water has proven useful particularly in the final stage of a multistage cleaner installation, arranged in cascade, as previously described herein.

The present invention is ideally suited to the use of elutriation water for the purpose of recovering, or preventing the rejection of, good fibre which would otherwise become part of the reject flow 54 leaving the device. FIG. 3 illustrates how this may readily be achieved.

In FIG. 3, the transition piece, here re-numbered as 64, is differently shaped, so that it contains an elutriation plenum 66 of annular form, into which an elutriation conduit 68 connects tangentially through elutriation opening 70. Additionally, a spacer piece 74 is provided, having an axial central orifice 78. This spacer piece is located between the transition piece 64 and the reject piece 28. The three pieces, as may be seen from the Figure, may usefully be all flanged together, and held by conventional flange bolts, not shown. Two gaskets 30, which also serve as shims to provide accurate axial dimensioning of the elutriation opening 72 and the reject opening 38, are provided, one above and one below the flange of the spacer piece 74.

It should be noted that the elutriation opening 72 is located above, i.e. upstream, of the reject opening 38. It should also be noted that axial central orifice 24 of the transition piece 64, the axial central orifice 78 of the spacer piece 74 and the axial central orifice 32 of the reject piece 28, together collectively define a passageway in the form of a surface of revolution about the axial centerline, which may either be cylindrical, as depicted in FIG. 3, or may be a hyperboloid of revolution or other compoundly curved shape, in a manner similar to that described in more detail in the embodiment of FIG. 2. Moreover, as in the case of the opening 38, the opening 72 represents an interruption in an otherwise smoothly continuous wall.

In operation, elutriation water, which is either water not containing fibre or particles, or water containing a very dilute concentration of fibres, here depicted by the arrow 76, is caused to enter the device under pressure from an external pump not shown, tangentially through the elutriation conduit 68 and the elutriation opening 70 into the elutriation plenum 66. It then passes inward through the elutriation opening 72, propelled by the pump pressure. As it enters, it has a tangential velocity, due to the tangential inlet at opening 70, and the annular shape of the elutriation plenum 66, so that as it enters through the opening 72, it has a similar tangential velocity to the main flow, and causes a minimum of disturbance to the flow pattern within. The added elutriation water diffuses through the passing dirt lamella, washing good fibre toward the axial centerline, while the rejectible particles of higher density remain near the wall, under the influence of their greater inertia due to higher density.

Thus it will be seen that, as the dirt lamella nears and finally leaves through the reject opening 38, it will then be composed of mainly rejectible high density particles, with a carrier fluid composed mainly of the recently-introducted elutriation water and containing a reduced amount of good fibre than would otherwise be the case.

Figure 4:
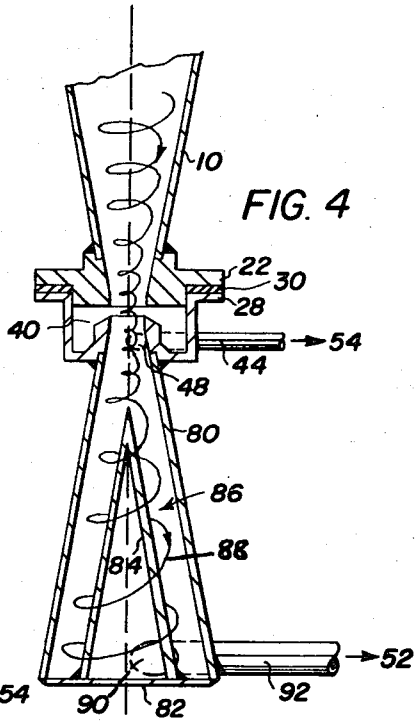
FIG. 4 is a partial vertical section, on the centerline, of one further embodiment of the invention.

FIG. 4 shows still another embodiment of the invention, incorporating a further working advantage. To the reject piece 28 there is attached, by welding or other suitable means, the small end of a truncated, hollow, imperforate, interiorly smooth, cone-shaped shell 80, in such manner that the interior of the small end of this shell 80 matches precisely with the opening 48 on the bottom side of the reject piece 28 to form a smooth flow passageway as shown. The large end of the shell 80 is imperforately closed, by welding or other means, by an imperforate cover plate 82. Radially inwardly spaced from the interior surface of the shell 80, and coaxial with the same axial centerline, is a complementary, imperforate, exteriorly smooth, inner cone 84. The shell 80 and the inner cone 84 together define a divergent, annular space 86. Near the cover plate 82, which is to say near the base of the shell 80, there is provided a tangentially disposed accept opening 90 leading to an accept conduit 92.

In the embodiments shown in the other Figures, as well as in centrifugal cleaners as generally employed, and other liquid cyclones, the pressure energy which the fluid contains on entry is transformed almost completely into velocity energy which is necessary for the separation of particles in the device. However, the velocity energy is largely dissipated by turbulence and fluid friction by the time the major flow, or accept flow leaves the device. In the embodiment in FIG. 4 there is shown a method and suitable means to recover at least some of the remaining velocity energy as pressure in the accept flow, so that, with the same flow rate and inlet or feed pressure, a higher pressure may be had in the accept flow than would otherwise be obtained. Since, in the paper industry, the stock after centrifugal cleaning passes to other stages of the process, which often are required to be supplied by stock under pressure, the use of the modifications of the embodiment shown in FIG. 4 may often mean the elimination of a pump which would otherwise be needed to impart further pressure energy to the stock after centrifugal cleaning.

In operation, the accept flow passing through the opening 48 in the reject piece 28 passes through the annular space 86 in a manner depicted diagrammatically by the divergently spiral flow path 88. In so doing, the flowing stock is gradually decelerated, in such manner that its remaining velocity energy may be at least partly converted back to pressure energy. In this manner, the accept flow 52 leaving by accept opening 90 and accept conduit 92 will contain some recovered pressure energy.

One further technical comment may be made here. Kelsall has demonstrated that all liquid cyclones contain an air core, and the devices of the present invention will be similar in this respect. Referring back to FIG. 1, the dotted lines 94 indicate the approximate location of the air core. The air core will extend approximately axially from end to end of the device. As Kelsall has shown, the air core will extend axially until it either meets a solid boundary, or passes out an opening of the device to the external atmosphere.

Referring to the free vortex equation, $VR^n$ equals a constant, this indicates that at very short radii, the velocity approaches infinity. Of course, this does not happen in practice, as an air cone forms.

In the case where the feed stock contains entrained bubbles of air, or dissolved air, the air core, will, as the name implies, be composed of air. In the event that the feed stock were to be completely deaerated before entry, the so-called air core would still exist, filled with water vapour, as the velocity of adjacent layers of stock in the vortex would be so high, and its pressure in consequence, so low, (having regard to the well-known Bernoulli equation in fluid mechanics), that the pressure would be below the vapour pressure of water. The radial extend of the air core will be dependent on the velocity of the fluid at entry, the available pressure energy, the radius of the device, and the temperature of the water. Its radial dimension will depend only slightly on the amount of entrained air or dissolved air in the incoming stock, as any extra air beyond that necessary to maintain the air core of such diameter that will be in dynamic equilibrium with the vortex, will be immediately entrained with the flow of accept stock leaving the device.

It will be apparent that the various details and features shown in the embodiments illustrated in the four Figures may be combined together in various ways, without restricting the generality of the present disclosure. Other applications, variations, and combinations will be readily apparent to those skilled in the art. For example, while the foregoing discussion covered embodiments of the invention suitable for separation of a class of particles from a mixture of particles in liquid suspension, of which the cleaning of papermaking stock was used as a specific example, it will be apparent that, as mentioned in the introduction, the invention has many other applications.

In certain applications where it is desired to remove finely divided particles from a flow of a gaseous medium, i.e. gas or vapour, and particularly where the finely divided particles have a density not very much greater than that of the carrying gas or vapour, another embodiment of the invention is applicable. In such other embodiment, the gas or vapour containing these particles forms a first feed that is introduced tangentially under pressure into the larger end of a generally cone-shaped chamber (as in the foregoing examples) and additionally a second feed in the form of a small flow of liquid, e.g. water, oil or a solvent, is also introduced through a suitable conduit preferably tangentially but not necessarily so, into the larger end of the chamber. Two separate conduits discharging separately into the chamber can be used for this purpose, or the two feeds can be premixed and introduced together through a single conduit.

The liquid, being of greater density than the gas or vapour, forms a "liquid lamella" with a narrow radial dimension covering the walls of the chamber, and this lamella moves towards the smaller end of the chamber and leaves through the peripheral (reject) opening or openings, while the gas or vapour flow leaves through the axial opening.

The finely divided particles initially carried in the stream of gas or vapour are flung outwards by centrifugal force, towards the circumferential wall of the chamber, where they contact and become entrained in the liquid lamella. Thus the particles leave the device with the liquid through the reject opening or openings, while the gas or vapour flow which now has substantially all of the particles removed from it leaves through the axial opening.

The flow of liquid with the entrained particles may be controlled as it leaves the device by connecting the reject opening or openings to a U-shaped passageway and thence directing the flow over an exit weir of adjustable height.

It will be apparent that the dimensions, and relative proportions of parts herein cited with reference to papermaking applications, will not necessarily apply to the processing of gas or vapour flows, having regard to the different viscosities and densities which apply to flows of gases and vapours, as compared to papermaking stock.

I claim:

1. Apparatus for centrifugal separation comprising (a) an elongated chamber of circular internal cross-section diminishing in diameter from an inlet end to an outlet end, (b) the inlet end being closed except for means for discharging pressurized fluid mixture into said inlet end with at least a tangential component of velocity whereby to cause such fluid mixture to flow around and along said chamber towards the outlet end with at least partial separation of the fluid mixture into a heavier, radially outwardly located fraction and a lighter, radially inwardly located fraction, and (c) the outlet end having an axially located, first circular opening to receive predominantly the lighter fraction and a peripherally located, second opening to receive predominantly the heavier fraction, said second opening being formed as an interruption in an outer wall that is otherwise smoothly continuous in the longitudinal direction of flow, and said outer wall maintaining in the longitudinal direction of flow from said second opening to said first opening a diameter at least as large as at the second opening.

2. Apparatus according to claim 1, wherein said fluid mixture is a liquid feed stock including solid particles in suspension.

3. Apparatus according to claim 1, wherein said second opening is an annular interruption in said outer wall.

4. Apparatus according to claim 1, 2 or 3, wherein said outer wall is cylindrical, from said second opening to said first opening.

5. Apparatus according to claim 1, 2 or 3, wherein said outer wall is a figure of revolution of a radially inwardly convex curve, said second opening being located in the vicinity of a portion of said wall of minimum diameter and said outer wall increasing in diameter in the longitudinal direction of flow from said second opening to said first opening.

6. Apparatus according to claim 1, 2 or 3, wherein said outer wall is a figure of revolution of an inwardly directed hyperboloid, said second opening being located in the vicinity of a portion of said wall of minimum diameter and said outer wall increasing in diameter in the longitudinal direction of flow from said second opening to said first opening.

7. Apparatus according to claim 1, 2 or 3, including a plenum surrounding said outer wall and communicating with said second opening.

8. Apparatus according to claim 1, 2 or 3, including valve means connected to said second opening for controlling the flow of said heavier fraction therethrough.

9. Apparatus according to claim 1, 2 or 3, wherein said chamber is frusto-conical.

10. Apparatus according to claim 1, 2 or 3, wherein said first opening opens into a further chamber located axially downstream of said first opening, said further chamber having a circular internal cross-section increasing in diameter from that of said first opening and a complementary inner member of circular cross-section located axially therein whereby to define an annulus of increasing diameter in the downstream direction, and a third opening located tangentially to a portion of said annulus of larger diameter to receive said lighter fraction.

11. Apparatus according to claim 1, 2 or 3, including a second interruption in a portion of said outer wall that is otherwise smoothly continuous in the longitudinal direction of flow, said second interruption being located upstream of the interruption forming said second opening, and means connected to said second interruption for pumping elutriation fluid therethrough into said heavier fraction.

12. A method of centrifugal separation of heavier and lighter fractions from a fluid mixture comprising (a) discharging said fluid mixture under pressure with at least a tangential component of velocity into an inlet end of an elongated chamber of circular internal cross-section that diminishes in diameter from the inlet end to an outlet end whereby to cause all said fluid mixture to flow around and along said chamber towards the outlet end and at least partially to separate into a heavier, radially outwardly located fraction and a lighter, radially inwardly located fraction, and (b) extracting said heavier fraction at a periphery of the outlet end substantially without interference with a smooth flow path of said lighter fraction in the longitudinal direction, while maintaining at least the full diameter of said flow path of said lighter fraction.

13. A method according to claim 12, wherein said fluid mixture is a liquid feed stock including solid particles in suspension.

14. A method according to claim 12 or 13, wherein said extraction step takes place at a location of minimum diameter of said chamber.

15. A method according to claim 12 or 13, including the step of expanding the diameter of flow of said lighter fraction downstream of the location of said extraction step whereby at least partially to convert velocity energy of said lighter fraction to pressure energy.

16. A method according to claim 12 or 13, including the step of injecting elutriation fluid into said heavier fraction upstream of the location of said extraction step, said injecting step being carried out substantially without interference with smooth flow of the lighter fraction in the longitudinal direction.

17. A method according to claim 12, wherein said fluid mixture comprises a first feed containing a gaseous medium and finely divided particles and a second feed consisting of a liquid.

18. A method according to claim 17, wherein said first and second feeds are separately introduced into said inlet end of the chamber.

19. A method according to claim 17, wherein said first and second feeds are combined before introduction into said inlet end of the chamber.

20. A method according to claim 17, wherein said heavier fraction consists primarily of said liquid and said particles, while said lighter fraction consists primarily of the gaseous medium.

21. A method of centrifugal separation of finely divided particles from a gaseous medium comprising (a) discharging said gaseous medium containing said particles under pressure with at least a tangential component of velocity into an inlet end of an elongated chamber of circular internal cross-section that diminishes in diameter from the inlet end to an outlet end, and simultaneously discharging a liquid into said inlet end, whereby to cause said gaseous medium, particles and liquid to intermingle while flowing around and along said chamber towards the outer end and at least partially to separate into a heavier, radially outwardly located fraction containing primarily said liquid and said particles and a lighter, radially inwardly located fraction containing primarily said gaseous medium, and (b) extracting said heavier fraction at a periphery of the outlet end substantially without interference with a smooth flow path of said lighter fraction in the longitudinal direction, while maintaining at least the full diameter of said flow path of said lighter fraction.

* * * * *